United States Patent [19]

Marcus

[11] Patent Number: 4,581,853

[45] Date of Patent: Apr. 15, 1986

[54] APPARATUS FOR INTERNAL FINISHING OF METAL PARTS

[76] Inventor: Ralph S. Marcus, 401 Dublin, Columbus, Ohio 43215

[21] Appl. No.: 598,395

[22] Filed: Apr. 10, 1984

Related U.S. Application Data

[63] Continuation of Ser. No. 344,313, Feb. 1, 1982, abandoned.

[51] Int. Cl.[4] ..... B24B 19/00

[52] U.S. Cl. ..... 51/7; 51/17

[58] Field of Search ..... 51/7, 16, 17, 317, 313

[56] References Cited

U.S. PATENT DOCUMENTS

| | | | |
|---|---|---|---|
| 3,142,939 | 8/1964 | Booker | 51/16 |
| 3,581,440 | 6/1971 | McKinney et al. | 51/7 |
| 3,662,496 | 5/1972 | Altenstaedter | 51/7 |
| 4,240,229 | 12/1980 | Ohno | 51/7 |
| 4,280,302 | 7/1981 | Ohno | 51/7 X |

*Primary Examiner*—E. R. Kazenske
*Assistant Examiner*—Willmon Fridie, Jr.
*Attorney, Agent, or Firm*—T. Gene Dillahunty

[57] ABSTRACT

This invention provides a process and apparatus for internal deburring, definning, and other internal finishing of metal parts by immersing the metal parts in a finishing media such as aluminum oxide and vibrating the metal parts at frequencies up to about 60 cycles per second.

5 Claims, 1 Drawing Figure

APPARATUS FOR INTERNAL FINISHING OF METAL PARTS

Figure 1:
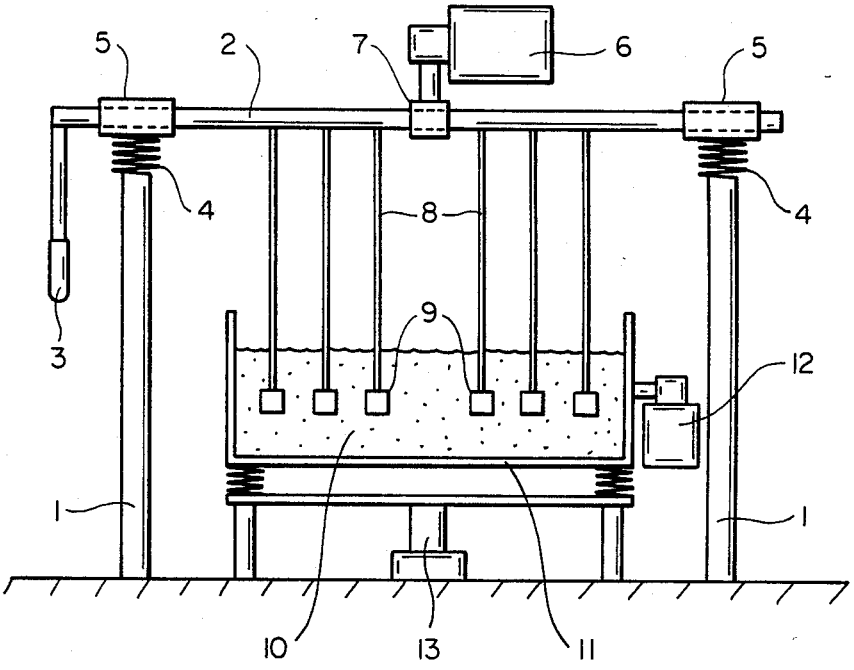

This application is a continuation of application Ser. No. 344,313, filed Feb. 1, 1982 now abandoned.

BACKGROUND OF THE INVENTION

This invention is in the field of metal finishing and relates to internal deburring of metal parts. Cleaning, deburring, definning, descaling and polishing internal areas of cast or molded metal parts has been done by various means, all of which have certain disadvantages. Until the late 1960's internal deburring was done by hand held power tools, which was inefficient and labor intensive.

Attempts to automate internal deburring include electro-chemical deburring, thermal deburring, extrusion honing and resonant deburring. The electro-chemical method requires that an electrode-probe be placed at an exact distance from the burr to be removed from the part and a controlled electrical discharge be released to contact the burr. This process is usually performed in an electrolytic chemical solution. The electric discharge removes or reduces the size of the burr. This process is not time efficient and requires precision operation in order to be effective.

Thermal deburring processes use a high pressure chamber in which the metal parts are placed. The chamber is then filled with an explosive gas mixture which is then ignited. The controlled explosion knocks and burns the burrs and fins off the part. This process has limited utility because of equipment cost, limited size of parts which will fit in the chamber, and, to some extent, safety considerations. Thermal deburring, however, does provide treatment of several parts at once instead of requiring treatment of each part individually. The effectiveness is difficult to predict and control because different size, shape and thickness of burrs, fins and flashing may require different explosion temperatures and impact forces to remove them.

The extrusion honing process requires fixing the part to be deburred on a machine which then forces or extrudes through the internal passages of the part a heavy material, such as a silicone putty, containing abrasive particles. As the abrasive putty flows through the part removing the burrs and honing sharp edges. The part must then be thoroughly cleaned to remove the putty, abrasive and metal particles. The extrusion honing process is a low production process requiring expensive equipment.

The resonant deburring involves attaching metal parts to the ends of a large steel alloy beam, submerging the part in an abrasive media, and vibrating the beam at a harmonic or resonant frequency of the beam. The beam is vibrated by a power source at the center of the beam and is mounted to a frame at two points on the beam which are the null points on the beam when in resonant vibration. The resonant deburring is a relatively quick process for the actual deburring of a part. However, since resonant deburring generally treats only two parts at once it is a low production process. Resonant deburring has the further disadvantages of high noise level due to the high frequency vibration in the range 4,800 to 8,000 vibrations per minute, high maintenance, and is usually only practical for relatively large parts.

Thus, it is apparent that prior to this invention there is no process or apparatus which provides effective and satisfactory internal deburring of metal parts at high production rates.

SUMMARY OF THE INVENTION

This invention comprises a process and apparatus for high production, internal deburring of metal parts. The metal parts which may be polished, cleaned, deburred or otherwise finished by the process and apparatus of this invention include but are not limited to cast metal parts and forged metal parts which contain internal fins or flashing, machined or drilled metal parts having internal burrs, cast metal parts having core sand adhering to the internal surfaces, and rusted or corroded parts with scale and the like on internal surfaces.

The process of this invention comprises attaching the article to be finished to a vibrating means and vibrating the article while submerged in a finishing media at relatively lower frequencies effective to achieve the desired finishing of the article. The article is immersed in the finishing media to allow the media to freely circulate through the interior of the article to provide the interior finishing. The media is provided in a container suitable for the media mixture of abrasives, liquid solutions and additives. The media mixtures of abrasives, solutions and additives are known in the art and vary according to the type of surface to be finished and the type of finishing desired.

The apparatus of this invention comprises a vibrating means for holding and vibrating the article to be finished while the article is submerged in the finishing media. As an illustration of the apparatus of this invention, the vibrating means may be a bar movably mounted on a frame with a vibrating motor and drive attached to the bar to provide vibration of the entire bar and the attached article. The motor and drive should be capable of vibrating the bar and the attached parts at varying frequencies and amplitudes. The bar may be of any length and configuration, such as parallel bars or the like, which the media container or containers can accommodate. This illustrates one of the advantages of this invention: high productivity. The vibrating means and the media container may be designed to accommodate a large number of metal parts which may be attached to the vibrating means and finished simultaneously.

The process of this invention involves attaching the parts to be internally finished to a vibrating means, immersing the parts in an abrasive media, and vibrating the parts while submerged in the abrasive media. The vibration frequencies employed in the process of this invention are less than about 60 cycles per second. The most effective frequency employed will depend on the type, size and shape of metal part being finished and the abrasive media employed. For most combinations of metal parts and abrasive media frequencies in the range of about 20 to about 50 cycles per second are useful. Many combinations are most effectively finished at about 40 to 45 cycles per second.

The abrasive media used in the process of this invention is selected from the abrasive media known in the art of vibratory finishing. As in the area of vibratory finishing, the composition, size and shape of the abrasive media usually determines the type of finishing which will be achieved, such as polishing, cleaning, descaling, deburring, etc., on the interior of the metal part. However, unlike conventional metal finishing, the media size and shape selected for use in the process of this invention is determined directly by the size, configuration and characteristics of the internal cavities of the metal parts. The media employed in the process of this invention may be used dry or in the presence of aqueous or solvent solutions. The solutions may contain various additives for lubricity and to aid in achieving the desired finish on the metal surface. The optional solutions and additives are selected for use in this invention on much the same basis as they are selected for use in conventional vibratory finishing.

THE PRIOR ART

The prior known processes and apparatus for internal deburring and surface finishing is summarized above in connection with the background relating to this invention. Of those known processes, the process which is most similar to the process of this invention is the resonant deburring process. The present invention differs from the resonant deburring process in a number of aspects. The frequency range employed is substantially different. The resonant deburring processes use high frequencies above 80 cycles per second and typically in the range of 80 to 135 cycles per second. It was previously generally accepted in the art that the higher frequencies were necessary in order to achieve internal deburring and other finishing. It has been unexpectedly found in this invention that the lower frequencies, i.e., below 60 cycles per second will give efficient internal finishing. It is also an unexpected benefit of this invention that it is easily adaptable to mass production due to the simple apparatus configuration by which the process of this invention is performed. Mass production is not practical on the resonant deburring apparatus because of the general limitation of two parts on the machine at one time, which limitation is due to the requirement that the machine be capable of vibrating at resonant or harmonic frequencies with the parts attached. The present invention enables operation at any appropriate frequency and with any number of parts.

The conventional mass vibratory finishing processes are unlike the process of the present invention. Vibratory finishing is effective for finishing the exterior surfaces of metal parts, but it does not treat internal surfaces. The media, solutions and additives used in vibratory finishing is generally useful in this invention. The size and shape of the media used in this invention will be determined by the size and configuration of the internal cavities of the metal parts to be subjected to internal deburring or other internal finishing.

EXAMPLES

The machine used in these examples is illustrated in FIG. 1. It is to be understood that the scope of this invention encompasses various configurations of apparatus. FIG. 1 represents one configuration which conveniently finishes a large number of parts according to this invention. In FIG. 1 support bar 2, having handle 3 attached thereto for rotating the bar, is spring mounted to frame 1 with springs 4 and mounts 5, which allow bar 2 to rotate therein through about 90° arc. Vibrating motor 6 is attached to bar 2 by mount 7 to provide means for vibrating bar 2 at frequencies up to about 60 cycles per second at amplitudes up to about 15 millimeters. The frequency and amplitude is controlled by a variable control to allow selecting any frequency and amplitude desired. A plurality of support means 8 are fixed to bar 2 and spaced along the length of bar 2 and the metal parts 9 are attached to supports 8. By rotating bar 2 with handle 3, the parts 9 can be lowered into and raised out of the media 10 in container 11. Container 11 can hold dry media or media in solutions.

Vibrating motor 12 is attached to container 11 to provide means for vibrating container 11 and media 10 contained therein, and lifting means 13 is provided to raise and lower container 11.

EXAMPLE 1

Die cast carburetor bodies having internal fins and machining burrs are attached to supports 8 in the machine of FIG. 1. The media 10 in container 11 is spherical glass beads made from optical crown, lead free, soda lime type glass with minimum silica content of 68% and minimum specific gravity of 2.45. The bead size ranges from 0.18 to 0.42 millimeters in diameter. Motor 6 is started at a frequency of 15 cycles per second. The amplitude is set at about 3 millimeters. Bar 2 is rotated to submerge the parts in the media and allow the media to fill the internal cavities of the carburetor bodies. The frequency is then increased to 30 cycles per second for three minutes, then to 60 cycles per second for five minutes. Then the frequency is reduced to 15 cycles per second and the parts raised out of the media by rotating bar 2. The parts are vibrated at 15 cycles per second until all media is out of the internal parts of the carburetor bodies—usually about 30 seconds. The carburetor bodies contain no significant internal fins or burrs after the above process.

EXAMPLE 2

In this Example the media is random shaped fused aluminum oxide with a uniform microcrystalline structure and a minimum hardness of 9.0 Mohs. and a nominal size of 1.7 millimeters. The media contains an aqueous solution containing a minimum of 1.0% sodium nitrite with a pH of about 9.0 to 9.5. The solution flow rate is about 600 milliliters per minute for each metal part being processed. The metal parts in this Example are cast iron 2½ inch standard hydraulic valve bodies having burned-in core sand, small fins and burrs on the internal surfaces resulting from the casting and machining operations. The valve bodies are attached to supports 8 on the above machine and the amplitude set at about 0.9 millimeter. The parts are submerged in the media by rotating bar 2. The frequency is set at 60 cycles per second. The amplitude is then increased to 6 to 8 millimeters for five minutes then decreased to about 0.9 millimeter and the parts raised out of the media. The amplitude is then increased to about 3 millimeters and the parts flushed with the aqueous solution until clean—usually about 1 minute. The valve bodies contained no significant sand, fins or burrs when finished.

It will be recognized that the apparatus and processes of this invention can vary from those specifically illustrated herein. For example, the media container may be raised and lowered to submerge the parts, whereby bar 2 need not rotate. The media container could be a vibratory container in order to obtain exterior finishing of the parts on the same machine that gives internal finishing.

I claim:

1. Apparatus for internal finishing of metal parts comprising a plurality of attaching means which are spaced along the length of a vibrating member and which are adapted for attaching the metal parts to the vibrating member, means for movably mounting the vibrating member on a frame comprising mounts on the vibrating member and springs between the mounts and the frame whereby the entire vibrating member is movable through the amplitude of the vibration, means for vibrating the vibrating member and the attached parts at varying frequencies and amplitudes, means for immersing the parts in a container of finishing media, means for vibrating the parts while submerged in the media and means for removing the parts from the media when the internal finishing is completed.

2. The apparatus of claim 1 wherein the vibrating member is rotatable to provide for immersing the part in and removing the part from the finishing media.

3. The apparatus of claim 2 comprising means for vibrating the media container.

4. The apparatus of claim 1 comprising means for raising the media container to immerse the part in the media and for lowering the media container to remove the part from the media.

5. The apparatus of claim 4 comprising means for vibrating the media container.

* * * * *